United States Patent [19]

Schweig, Jr. et al.

[11] 4,060,444

[45] Nov. 29, 1977

[54] TAPE APPLICATOR

[76] Inventors: Eugene S. Schweig, Jr., 6900 Washington, St. Louis, Mo. 63130; Marcus I. Diehl, 7023 Florence, St. Louis, Mo. 63136

[21] Appl. No.: 777,393

[22] Filed: Mar. 14, 1977

Related U.S. Application Data

[63] Continuation of Ser. No. 600,459, July 30, 1975, abandoned.

[51] Int. Cl.[2] ..... B44C 7/02; B65H 19/02

[52] U.S. Cl. ..... 156/391; 156/577; 156/584; 206/394; 206/395; 206/411

[58] Field of Search ..... 156/391, 523, 524, 526, 156/525, 527, 574, 577, 579, 584, 554; 225/46, 48, 50, 88; 206/394, 395, 396, 411, 409

[56] References Cited

U.S. PATENT DOCUMENTS

| | | | |
|---|---|---|---|
| 2,400,435 | 5/1946 | Nelson et al. | 156/527 |
| 2,890,808 | 6/1959 | Seror | 156/577 |
| 2,953,274 | 9/1960 | Bertschinger | 156/577 |
| 3,371,776 | 3/1968 | Voissem | 206/394 |
| 3,536,569 | 10/1970 | Gosnell | 156/527 |
| 3,587,840 | 6/1971 | Hultberg | 206/395 |
| 3,645,831 | 2/1972 | Thaeler | 156/574 X |
| 3,748,211 | 7/1973 | Hoopengardner | 156/577 X |
| 3,869,094 | 3/1975 | Weick et al. | 156/577 X |
| 3,871,940 | 3/1975 | Antonioni | 156/523 X |
| 3,900,362 | 8/1975 | Schaffer | 156/574 X |

*Primary Examiner*—Charles E. Van Horn
*Assistant Examiner*—M. G. Wityshyn
*Attorney, Agent, or Firm*—Rogers, Eilers & Howell

[57] ABSTRACT

A tape applicator including a frame with a rotatable mandrel for mounting one or more rolls of adhesive tape, the frame including a flat, elongated portion under which the tape passes and which acts to apply the tape positively and firmly to a selected surface as the applicator is moved thereover, and the frame further including guides at the location of the elongated portion through which the tape passes to insure accuracy in application and equidistant spacing between multiple tape strips. The guides also act as means for removing any tape lining as the tape is applied. The applicator is designed for one hand operation and is disposable, being constructed of inexpensive materials with the frame preferably formed from a flat cutout of paperboard or the like.

22 Claims, 12 Drawing Figures

TAPE APPLICATOR

This is a continuation, of application Ser. No. 600,459 filed July 30, 1975, now abandoned.

BACKGROUND OF THE INVENTION

Tape applicators for applying strips and sheets of adhesive materials are known in the art. These include applicators for applying adhesive materials with liners such as U.S. Pat. Nos. 3,274,038 and 3,737,360, as well as applicators for applying two strips such as U.S. Pat. Nos. 3,150,027 and 1,739,269. However, heretofore there has not been known an applicator for applying one or more strips of tape with exceptional accuracy, with positive surface pressure for starting the tape strips when they are applied, and yet, because of its unique design, which is totally disposable so that the tape and applicator can be marketed as a unit and the purchase buys a new applicator with each tape purchase.

SUMMARY OF THE INVENTION

The tape applicator of this invention generally comprises a frame constructed from a cutout of a paperboard or the like having ear portions which are folded along foldlines to form opposing sides. The sides are connected by a flat, elongated bottom portion at the end of which are located guides for tape strips so they are fed from tape rolls. A mandrel is mounted between the sides with the tape rolls mounted thereon, and the tape strips are fed from the rolls past the guides and beneath the elongated portion with the adhesive side down for application to a selected surface. The elongated portion extends forwardly of the sides and includes marking means for accurately applying the strips. The applicator is designed for operation with one hand with the thumb and third finger on opposite sides of the mandrel and the first and middle finger on top of the forwardly extending portion of the frame. The user operates the applicator by in effect wiping the flat, elongated portion over a selected surface with the tape strips feeding off the rolls through the guides and beneath the elongated portion and onto the selected surface.

The guides are located directly at the point of application and thereby provide a very accurate means for applying the tape. The applicator design of this invention is readily adaptable to either single or multiple strip applications, and its simplicity particularly allows for use of very inexpensive materials, thus providing an applicator that is truly disposable. The applicator of this invention can be seen to be useful in applying tape for many different purposes, but is particularly useful for applying pinstriping because of its ease of operation and accuracy.

Thus, it is a primary object of this invention to provide a tape applicator for applying one or more strips of tape to a selected surface easily and accurately, and further to provide such a device that is truly disposable allowing the purchaser to buy an applicator with each tape purchase. This and other objects of the invention will become apparent from the detailed description to follow.

DESCRIPTION OF A PREFERRED EMBODIMENT

Figure 8:
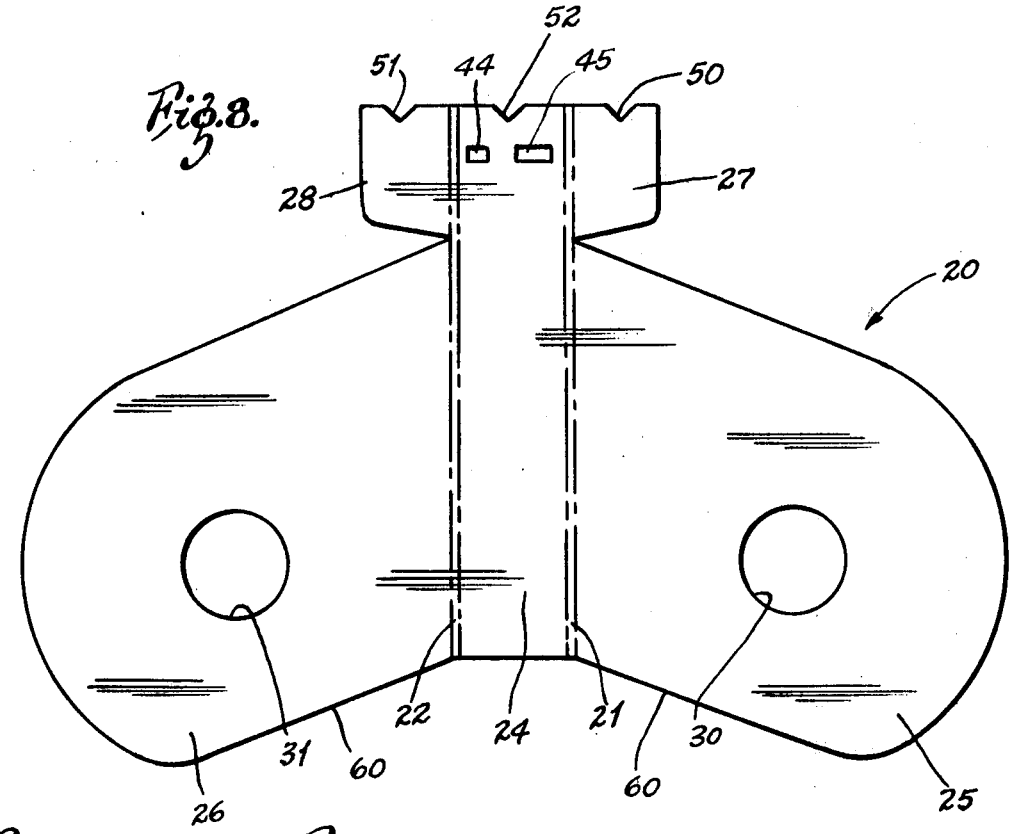
FIG. 8 is a plan view of the applicator frame in its flat configuration.

Referring to the drawing, there is shown an applicator 18 of this invention comprising a frame 20 made preferably from a flat cutout as best shown in FIG. 8. The frame includes parallel creases or foldlines 21 and 22 located in the middle and running the length of the frame. These creases divide the frame into a bottom section 24, a side section or ear 25, an ear 26, a side frontal section 27, and a side frontal section 28. The ears 25 and 26 fold along the lines 21 and 22 to stand upright and perpendicular to the bottom section 24, and have circular holes 30 and 31, respectively, which are aligned when the ears are in their folded parallel configuration. It can be seen that the entire frame can be made of a very inexpensive material such as a diecut of paperboard or the like.

Figures 1, 2, 3, 4, 5, 6, 11, 12:
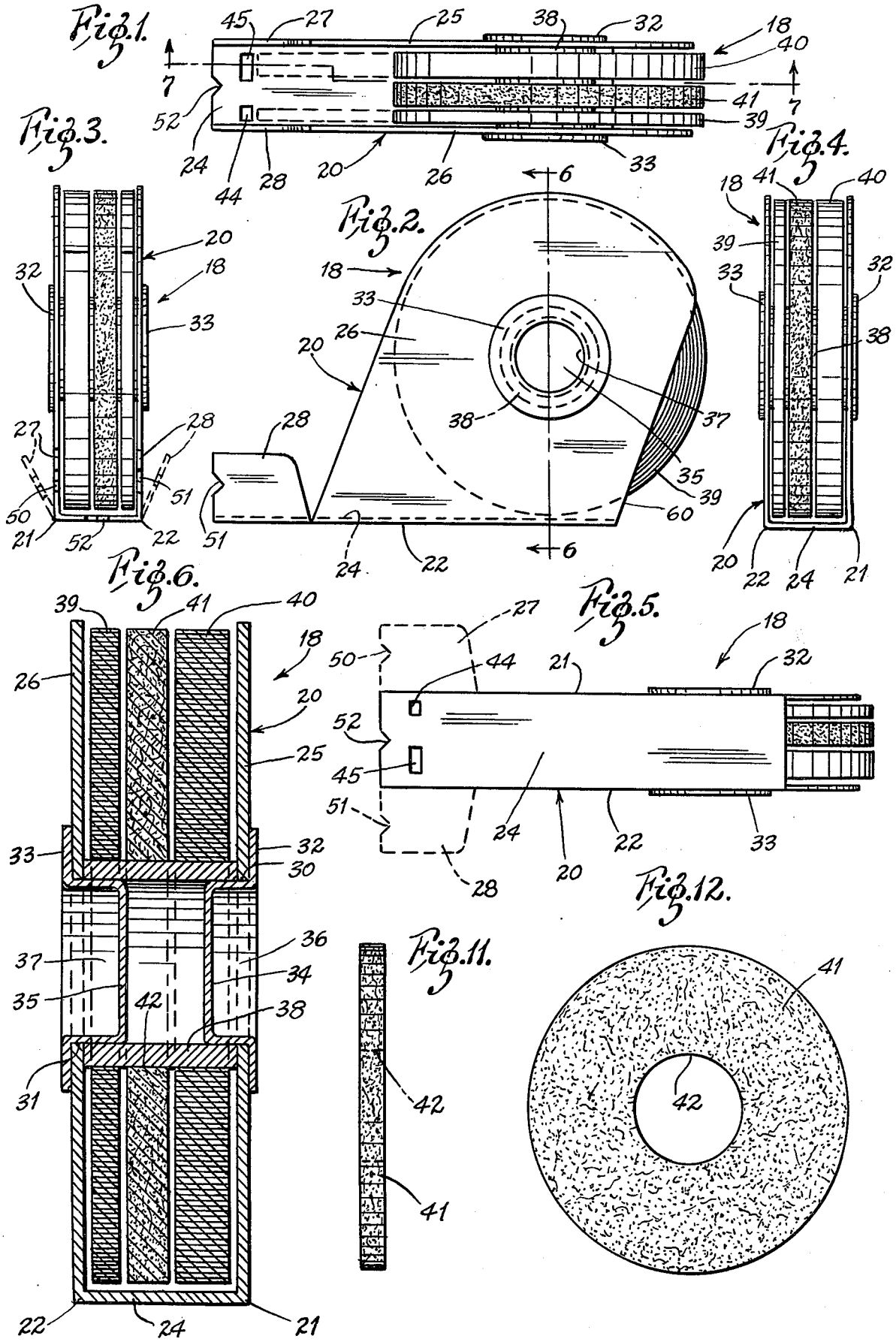
FIG. 1 is a top plan view of a tape applicator of this invention.
FIG. 2 is a side elevation view of the tape applicator of FIG. 1.
FIG. 3 is a left end view of FIG. 2.
FIG. 4 is a right end view of FIG. 2.
FIG. 5 is a bottom view of FIG. 2, but with the side frontal flaps shown in dashed lines and in a flat configuration.
FIG. 6 is an enlarged view in section taken generally along the lines 6—6 of FIG. 2.
FIG. 11 is an end view of a spacer used in the applicator of this invention.
FIG. 12 is a side view of the spacer of FIG. 11.
Figure 9:
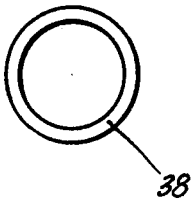
FIG. 9 is an end view of the mandrel used in the applicator of this invention.
Figure 10:
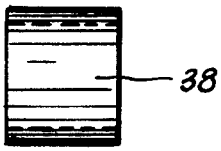
FIG. 10 is a side view of the mandrel of FIG. 9.

As best shown in FIG. 6, end caps 32 and 33, having central holes 34 and 35 forming external recesses 36 and 37, are inserted through the holes 30 and 31, respectively, with the central hub portions of the caps extending through the holes and toward each other past the ears 25 and 26. A cylindrical mandrel 38, as best shown in FIGS. 6, 9, and 10, is mounted on the central hubs of the caps 32 and 33.

Mounted on the mandrel 38 are tape rolls 39 and 40, the rolls having suitable cores through which the mandrel extends. The tape rolls are rotatably mounted about the mandrel 38 for rotation within the frame. A cylindrical spacer 41 is located between the rolls 39 and 40 and has a central bore 42 through which the mandrel 38 extends for rotatably mounting the spacer on the mandrel. The spacer 41 holds the tape rolls a selected distance apart and is preferably made of a material which does not stick to the adhesive on the tape. It is to be understood that where a single tape roll is used, a spacer may not be necessary, and where more than two tape rolls are used, spacers should preferably be located between each of the rolls to maintain them approximately the same distance apart as the applied strips.

Rectangular guides or slots 44 and 45 are located near the front end of the bottom section 24 of the frame. These slots are sized so as to be slightly greater than the width of the tapes to be applied from the rolls 39 and 40, but should not be so large as to allow any appreciable play. The width tolerances of the slots should be sufficiently close so that the tape strips will not wobble from side to side as they feed through the slots during application. The slot 44 is aligned with the tape roll 39, and the slot 45 is likewise aligned with the tape roll 40 to provide a smooth feed of the tape from the rolls and onto the selected surface. There should be as many aligned slots as there are tape rolls.

The flaps 27 and 28 of the frame can be in either the flat configuration with the bottom section 24, as for operation of the applicator, or can be folded upwardly for shipment as shown in FIG. 3. The flap 27 has a notch 50 in its front end, the flap 28 has a notch 51 in its front end, and another notch 52 is formed in the front end of the bottom section 24. These notches serve as markers for use as desired in applying the tape, such as where the user wished to follow a thin, preselected path, or the like. The frame 20 is cut away at its rear portion as shown at 60 to allow easy access to the tape rolls for threading the strips through the guides 44 and 45.

OPERATION

To assemble the applicator the caps 32 and 33 are inserted through the holes 30 and 31 in the ears, and the ears are folded along the line 20 and 22. One end of the mandrel 38 is then fitted over the hub of one of the caps 32 and 33, after which the roll 39, spacer 41, and roll 40 are slipped over the mandrel.

With the tape rolls and spacer in place on the mandrel, the ears 25 and 26 are then brought to a parallel configuration until the other end cap is inserted in the opposite end of the mandrel. When this occurs, the ears 25 and 26 are perpendicular to the bottom section 24.

It is to be understood, of course, that the rolls 39 and 40 are placed on the mandrel in an appropriate order so that the width of each roll corresponds to the width of its associated slot. The spacer 41 insures proper alignment.

Figure 7:
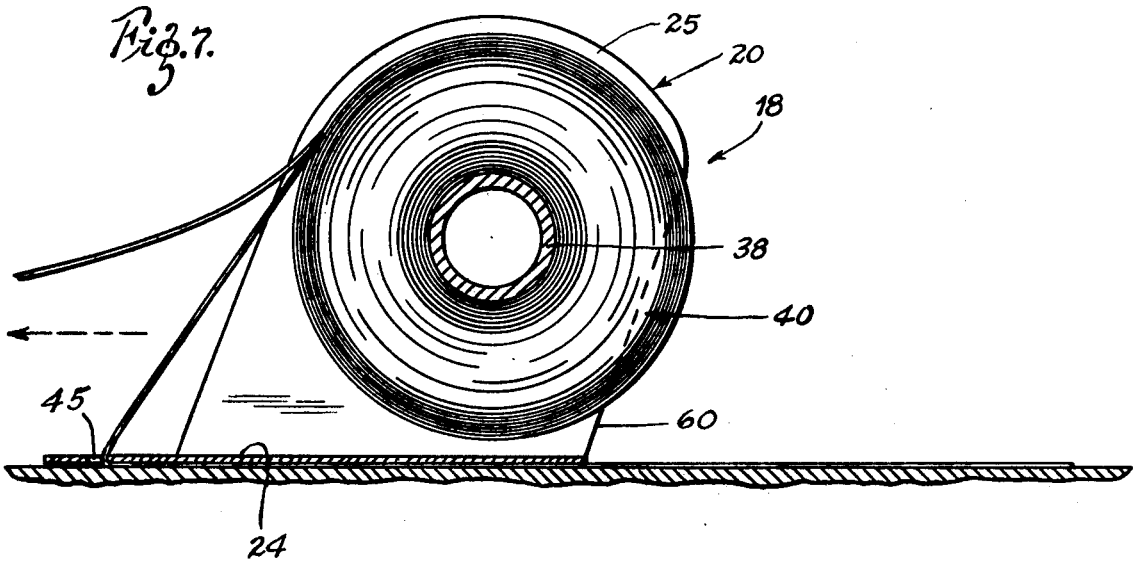
FIG. 7 is a side sectional view of the tape applicator of FIG. 2 showing the path of travel of a tape strip and its liner as the strip is applied from the roll to a selected surface.

After the rolls 39 and 40 are inserted within the applicator frame, the tape is unwound from each roll and fed through its corresponding slot 44 or 45 at the front of the applicator. If the tape is of the type having a liner on the adhesive side, the liner is first peeled away from the tape at the front of the applicator before the tape is inserted through the slot (FIG. 7). The tape strips are then directed rearwardly from the slot beneath the elongated bottom section 24 with the adhesive side down, and with the liners (if present) extending forwardly from the slots on top of the section 24.

With the tape so threaded, they are ready for application. This is accomplished by placing the bottom side of the section 24 firmly against the surface to which the tape is to be applied. With the thumb and third finger of one hand in the recesses 36 and 37 of the caps 32 and 33, and with the index and middle fingers extended forwardly in contact with and pressed against the flaps 28 and 27, the applicator is moved forwardly over the surface. As the applicator is moved, the bottom flat, elongated section 24 presses the tape onto the surface to provide positive pressure contact, and the tape is continuously pulled off the rolls and through the slots 44 and 45 with the tape strips being applied accurately and equidistantly. The location of the slots 44 and 45 directly at the pressure surface 24 further insures accurate and equidistant application of the strips. As the strips are applied, the liners (if present) are automatically peeled away by contact with the upper surface of the section 24 at the location of the notches 44 and 45, with the liner feeding in the forward direction. Because of the curved nature of the liner in the tape roll, it tends to curl upwardly and then backwardly as it is separated, and therefore does not interfere with application of the tape. The applicator can be moved in either straight or curved lines, and the notch markers 50, 51, and 52 at the front of the applicator can be used as desired for guiding the applicator along a selected path.

It can be seen that the applicator is operated with one hand, freeing the other hand from other operations, and the entire applicator is made of relatively few parts and of very inexpensive materials, the entire frame being a flat cutout of paperboard or the like, the mandrel being, for example, a paperboard cylinder, and end caps being, for example, of plastic. Thus, the applicator can be made so inexpensively that it can be supplied as a kit with each tape roll or rolls as a disposable unit. With this invention, one need not invest in an expensive applicator for one time use.

Thus, there has been described a tape applicator of this invention which is very inexpensive to manufacture and therefore disposable, which is easily adaptable for use in applying single strips or multiple strips of tape, which may be used with either lined or unlined tape, and which includes improved means for positively applying the tape to the desired surface and for doing so accurately.

Various changes and modifications may be made in this invention, as will be readily apparent to those skilled in the art. Such changes and modifications are within the scope and teaching of this invention as defined by the claimed appended hereto.

What is claimed is:

1. A tape applicator for applying tape to a surface, said applicator comprising a frame, means for rotatably supporting at least one tape roll within said frame for permitting withdrawal of said tape from said roll, a flat elongated pressure surface located at the bottom of the frame for sliding pressure engagement of at least a substantial portion of said pressure surface with the upper side of said tape as said applicator is pushed forwardly over said surface, said elongated pressure surface having a forwardly extending portion adapted for the placement of the ends of the index and middle fingers of one hand which extend forwardly thereto from above the frame for applying pressure during operation of the applicator, and means located near the points of pressure contact by said fingers for guiding said tape from said roll and into contact with the surface to which the tape is to be applied, the bottom side of the tape contacting the surface adjacent the points of pressure contact of the fingers, said guide means further guiding the tape rearwardly under said elongated pressure surface as said fingers apply pressure at the point of initial tape contact with the surface as said applicator is pushed forwardly over said surface to which the tape is to be applied.

2. The applicator of claim 10 wherein the means to rotatably support at least one tape roll comprises a mandrel mounted on the frame.

3. The applicator of claim 2 wherein said at least one tape roll is rotatably mounted on said mandrel, said mandrel having recesses on opposite ends thereof adapted to receive the ends of the thumb and another finger of the hand for operation of said applicator.

4. The applicator of claim 1 further comprising spacer means mounted within said frame for separating multiple rolls of tape.

5. The applicator of claim 1 in which the frame has an exposed front side, top side, and back side.

6. The tape applicator of claim 1 wherein said guide means comprises a slot formed in said pressure surface at the forward end of said pressure surface portion adjacent the points of pressure contact by said fingers.

7. The applicator of claim 1 wherein said frame further comprises parallel side portions and a flat, elongated interconnecting bottom portion defining said elongated pressure surface, said at least one tape roll being rotatably mounted between said side portions, said guide means being formed in said pressure surface portion to guide the tape strip from the roll and under said elongated pressure surface, said frame being formed from a single flat layout of material.

8. The applicator of claim 7 wherein the frame is formed of paperboard.

9. The applicator of claim 7 wherein the means for rotatably mounting said at least one tape roll comprises a mandrel mounted between said parallel side portions of the frame.

10. The applicator of claim 9 further comprising means located at the front of said applicator for use in following a preselected marked path during operation of the applicator.

11. The applicator of claim 10 wherein said side portions of said frame have aligned holes, said applicator further comprising hub means mounted in said holes, said mandrel being mounted on said hub means.

12. The applicator of claim 11 wherein said frame is cut away at a rear portion thereof so that the radial distance from the center of rotation of said tape roll to said rear portion is less than the radial distance from said center of rotation to other portions of the frame.

13. The tape applicator of claim 1 further comprising external recesses at the sides of said frame adapted to receive the end of the thumb and third finger of the hand.

14. A tape applicator for applying tape to a surface, said applicator comprising a frame having parallel side portions and a flat elongated interconnecting bottom portion, means for rotatably mounting at least one roll of tape between the sides of said frame, said bottom portion extending beneath said tape roll and extending at least most of the length of the applicator to apply pressure along most of its length to the tape during application, means defining slots in the forward end of said bottom portion for guiding tape out of said applicator and rearwardly under said bottom portion, said slots aligning the tape as it is applied to the receiving surface, and means at the forward end of said bottom portion adapted to receive the index and middle fingers of one hand to apply pressure to the tape at the location where it leaves the applicator through the slots and into engagement with the receiving surface thereby insuring positive initial engagement between the tape and the receiving surface.

15. The tape applicator of claim 14 wherein the bottom portion projects forwardly of said side portions of the frame, said means adapted to receive the ends of the index and middle fingers comprising flaps extending laterally to each side frame said forward projection and adapted to receive the ends of the index and middle fingers of the hand with said fingers extending from the top of the side portions and forwardly and downwardly to the flaps without interference from the side portions.

16. The tape applicator of claim 15 wherein said slot means are located between said flaps, whereby said slot means guide the tape from the roll, into contact with the receiving surface, and rearwardly beneath the elongated bottom portion without interference from the fingers.

17. The tape applicator of claim 14 wherein the tape has a backing adapted to its adhesive side, the slots being adapted to separate said backing from the tape adjacent the point of application of the tape to the surface during operation of the applicator.

18. The applicator of claim 14 further comprising spacer means for separating two or more rolls of tape rotatably mounted between said sides, and wherein the slots are adapted to maintain the same spacing between the tapes as they are applied to the surface by the applicator.

19. The tape applicator of claim 18 wherein the slots are sized to receive tapes of preselected widths.

20. The tape applicator of claim 14 wherein the frame is formed from a single flat layout of material.

21. A tape applicator for applying tape to a surface while separating a backing from the adhesive side of the tape comprising a one piece die-cut frame having indentations defining foldable, parallel side portions, and a flat, elongated interconnecting bottom portion having a forward end, flap portions located forwardly of the parallel side portions and extending laterally from the forward end of the bottom portion adapted to receive the ends of the index and middle fingers of the hand with the index and middle fingers extending forwardly and downwardly to said flaps without interference from the parallel side portions during operation of the applicator, means for rotatably mounting at least one roll of tape between said sides, means defining slots in the forward end of the bottom portion between said flaps and at a location adjacent the points of pressure contact of the index and middle fingers, each slot being sized to accept a preselected width of tape and positioned to align the tape as it is applied to the receiving surface, said slots being adapted to receive and guide the tape from the roll and separate the backing from its adhesive side as the tape is initially applied to the receiving surface at the location adjacent the pressure contact of the index and middle fingers and further guide the tape rearwardly beneath the elongated bottom portion without obstruction from the index and middle fingers, the flaps providing means for applying substantial pressure through the index and middle fingers pressing thereon, which pressure is applied to the tape at the point of initial engagement with the receiving surface, said bottom portion cooperating with the pressure applied at the flaps to apply pressure to the tape along the length of the bottom portion to insure positive engagement between the tape and the receiving surface.

22. The tape applicator of claim 21 wherein said parallel sides have external recesses for receiving the ends of the thumb and third finger of the hand, said bottom portion cooperating with the pressure applied at the flaps and further pressure applied by the thumb and third fingers to apply pressure to the tape along the length of the bottom portion to insure positive engagement between the tape and the receiving surface.

* * * * *